United States Patent [19]

Botts

[11] 4,214,628

[45] Jul. 29, 1980

[54] MULTIPLE-PURPOSE UNDERGROUND FLUID INJECTION SYSTEM

[76] Inventor: Elton M. Botts, 2901 Western Ave., Mattoon, Ill. 61938

[21] Appl. No.: 923,669

[22] Filed: Jul. 11, 1978

[51] Int. Cl.[2] ..... E21B 33/00

[52] U.S. Cl. ..... 166/75 R; 166/305 D

[58] Field of Search ..... 166/75 R, 90, 305 D, 166/308, 244 C

[56] References Cited

U.S. PATENT DOCUMENTS

| | | | |
|---|---|---|---|
| 2,261,100 | 10/1941 | Erwin | 166/305 D |
| 3,375,666 | 4/1968 | Sutton | 166/305 D |
| 3,768,865 | 10/1973 | Dehn | 166/305 D |

*Primary Examiner*—James A. Leppink

*Attorney, Agent, or Firm*—Clarence A. O'Brien; Harvey B. Jacobson

[57] ABSTRACT

A system for injecting fluid into underground formations for various purposes including the secondary and tertiary recovery of oil or other hydrocarbons from underground formations, storage of fresh water in underground formations, recharging depleted or insufficient fresh water underground strata from rainfall run off or other sources of fresh water to provide fresh water supply during low rainfall periods or the like, disposal of brine or saline solutions into underground formations where such solutions will be purified by filtering through porous media and disposal of contaminated fluids resulting from industrial, chemical processes, and the like. The system includes a unique injector capable of gravity flow injection or pressure injection by use of a pump arrangement with the gravity flow of fluids such as water enabling turbines to be utilized in the flow path at a point having the necessary water head and pressure characteristics to rotate a generator for providing electrical energy to power certain components of the equipment or for use in any manner desired.

7 Claims, 7 Drawing Figures

62
68
64
66
138
40
56
132
134
136
20
4
124
92
94
122
100
90
3
3
87
5
96
80
108
128
78
5
84
70
116
24
130
114
104
120
86
98
4
60
82
58
36
34
44
32
38
40
18
46
48
42

MULTIPLE-PURPOSE UNDERGROUND FLUID INJECTION SYSTEM

BACKGROUND OF THE INVENTION

1. Field of the Invention

The present invention generally relates to the injection of fluid into underground strata for various purposes with the system including an injector for effective control of injection of fluid into an underground formation by the use of pumps for injection under pressure, or gravity flow depending upon the fluid being injected, the characteristics of the underground formation into which the fluid is being injected and the function of the injection system.

2. Description of the Prior Art

It is well-known to inject fluids into underground hydrocarbon reservoirs or formations for the purpose of recovering additional hydrocarbon liquids. This technique, generally referred to as secondary or tertiary recovery, includes pumping of the fluid into an injection well at a high pressure which requires the use of a plurality and relatively long high pressure pipelines extending from a high pressure pump to a plurality of injection wells. Such techniques, while having some degree of success, have many inherent disadvantages and limitations. For example, the control of the quantity of fluid injected at each individual well has not been too successful. When choking the fluid flow in the system to direct more fluid to a particular well usually results in an increase of resistance or pressure throughout the system and this increase requires a corresponding increase in horsepower at the central pump or pumps in order to maintain volume which in turn increases the pipeline pressure resulting in pipeline failures which, of course, can cause the complete shutdown of the flooding operation. The known techniques also result in high energy consumption relative to the volume of fluid injected due to resistance to flow in the pipeline system which must be overcome by the pumps. Also, relatively poor sweep efficiency of the flooding fluids within the hydrocarbon reservoir occurs due to the limited flexibility of the system, all of which results in unacceptable total losses of hydrocarbons throughout the world. As a result of inefficiencies inherent in the present techniques and the costs involved, there have been many instances in which secondary or tertiary recovery of hydrocarbon fluids from reservoirs has been found to result in large energy and monetary losses, thereby rendering the recovery operation economically unprofitable.

In regard to other problems which are encountered throughout the world, underground water supplies have diminished or become unusable because of excessive use, depletion and the like. However, in many of these areas, at certain periods, there is an excess supply of fresh water which results from rainfall or in neighboring geographical areas, there may be an excess supply of fresh water which could be effectively utilized if supplied to a water depleted area by an economical means. In many instances, underground aquifers and other water bearing strata have been exhausted by excessive removal of underground water without regard to the depletion of the supply. Many efforts have been made to impound excessive water supply by using dams to form surface reservoirs which, of course, are used in many localities but which suffer from extreme loss due to evaporation and can become contaminated as well as utilizing substantial land areas that could be better utilized for other purposes.

SUMMARY OF THE INVENTION

An object of the present invention is to provide an underground fluid injection system which includes an injector located at each injection well site associated with a supply of treated or filtered fluid by a gravity flow system or low pressure flow system so that extensive high pressure pipelines are eliminated with each well injector being continuously supplied with fluid to be injected by an adequately sized, low pressure, non-corrosive, non-conductive pipeline system by gravity fall from an elevated tank or by a low pressure, high volume, pressure regulated pump.

Another object of the invention is to provide an injector as set forth in the preceding object that includes a vessel which serves as a storage tank for the fluids arriving at each injector, a high speed, high pressure multi-cylinder pump assembly driven by a variable speed electric motor, final screening and filtering arrangement, individually driven, rate adjustable injector means for the injection of polymers, bactericides, detergents or other added liquids when needed, a flow meter for accurate measurement of total fluids injected, a sensing system to start up or shutdown the motors relative to fluid availability, a control unit coupled to the sensing system to control the system, an electronic interface and data transmission and receiving system to be made available where remote sensing and control are desired, manual or automatic controls of volume, pressure and rates, fluid taps for testing of fluid at the unit before injection and a shutoff system to control any overflow condition.

When using the system for fresh water injection into underground reservoirs to recharge depleted or insufficient fresh water underground strata from rainfall run off or other sources of fresh water, a series of strategically located wells can be drilled and completed to assure that water injected would enter the desired strata and only the desired strata and at each of these wells, an injection unit would be installed similar to those used in injecting fluids into a hydrocarbon reservoir with the only differences being the size and accessories involved to comply with any legal, sanitary, or health requirements. This would enable fresh water to be collected in ponds, lakes, or behind dams or run off areas which provide the least contamination possible and as soon as water becomes available in these areas, the water, after filtering, purifying, clarifying, or other processes necessary, would be conveyed by gravity fall or high volume, low pressure pumps to elevated tanks so that the water will flow by gravity fall through adequately sized, underground, non-corrosive, non-conductive pipelines to each injector unit for injection into the desired underground strata either by gravity flow or by pump depending upon the permeability of the underground strata.

When injecting fresh water into underground strata, natural underground filtering and purification will be effected by flowing water through the porous medium of the underground reservoirs. This also results in natural cooling of the water, reduction of evaporative losses, improvement in the potability of water, less risk of deliberate contamination, a balancing effect in many geographic areas where cyclic drought occurs, regulated agriculture balance to water availability without excessive evaporative losses, slightly saline underground reservoirs in some regions will become less saline and will reach potable levels and, in some instances, the gravity fall of water can be used to generate electricity for more efficient operation of the system.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
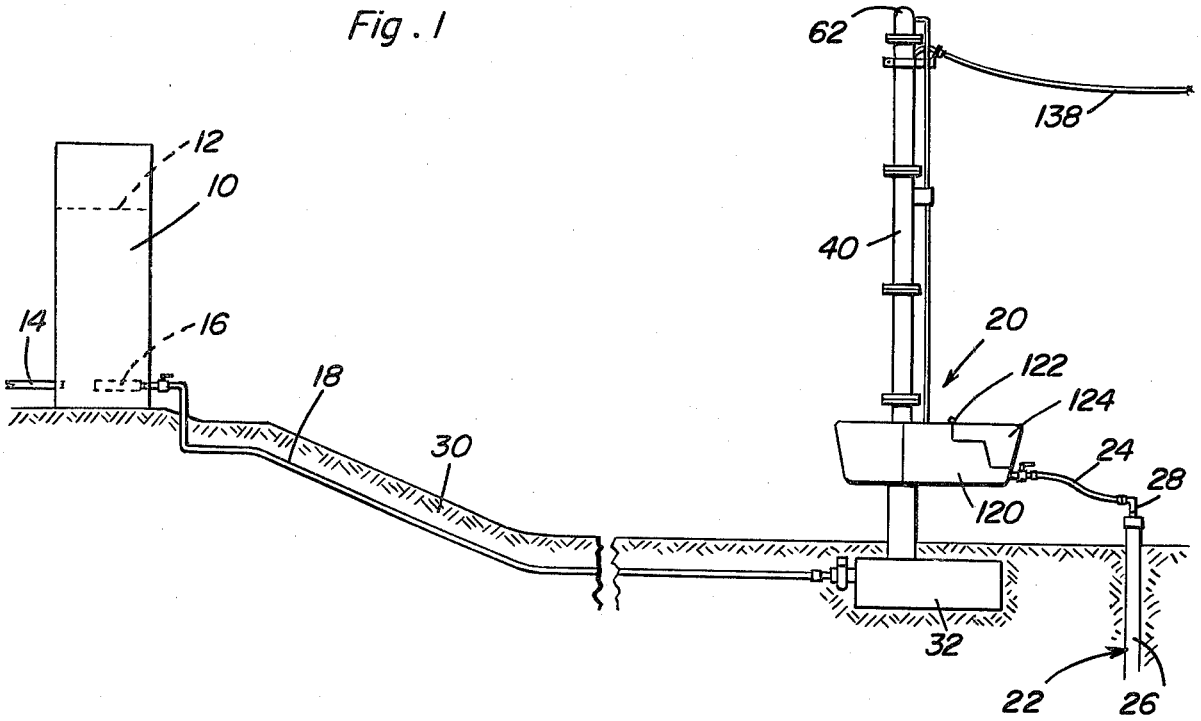
FIG. 1 is a schematic elevational view illustrating a typical installation in which injection fluid is stored in an elevated tank and supplied to a well injector by gravity flow.

Referring now specifically to the drawings, FIG. 1 illustrates schematically the system of the present invention including an elevated tank 10 having a quantity of injection fluids, such as water, therein with the fluid level being indicated by numeral 12. The tank is supplied with injection fluid through a suitable supply pipe 14 connected with a gravity supply, pump supply, or other supply, of injection fluid with the level of the invention fluid in the tank 10 being maintained at any suitable point above an outlet screen 16 adjacent the lower end of the tank which is connected to a gravity flow pipeline 18 that extends to a lower elevation and connects with a well injector generally designated by the numeral 20 which discharges injection fluid into a well generally designated by numeral 22 through a suitable flexible or other conduit 24 connected to the upper end of the well casing 26 by a suitable fitting 28. While a gravity flow system has been illustrated from the tank 10 to the injector 20, in certain installations, it may be desirable to utilize a low pressure high volume pump to supply injection fluid to the well injector 20. In other instances, injection fluid, such as water, may be conveyed from a water impoundment site such as a lake, pond, river, reservoir, or the like, through the pipeline 18 to the well injector 20 with the pipeline 18 being low pressure, non-corrosive, non-conductive and not subject to evaporation or freezing due to contact with atmosphere since it is usually desirable for the pipeline to be disposed below ground as indicated by numeral 30. Thus, it will be appreciated that various installational requirements may be complied with for supplying low pressure high volume injection fluid to the well injector 20. Any filtering or other treatment of the water is accomplished prior to delivery of the water or other fluid to the well injector 20.

Figure 2:
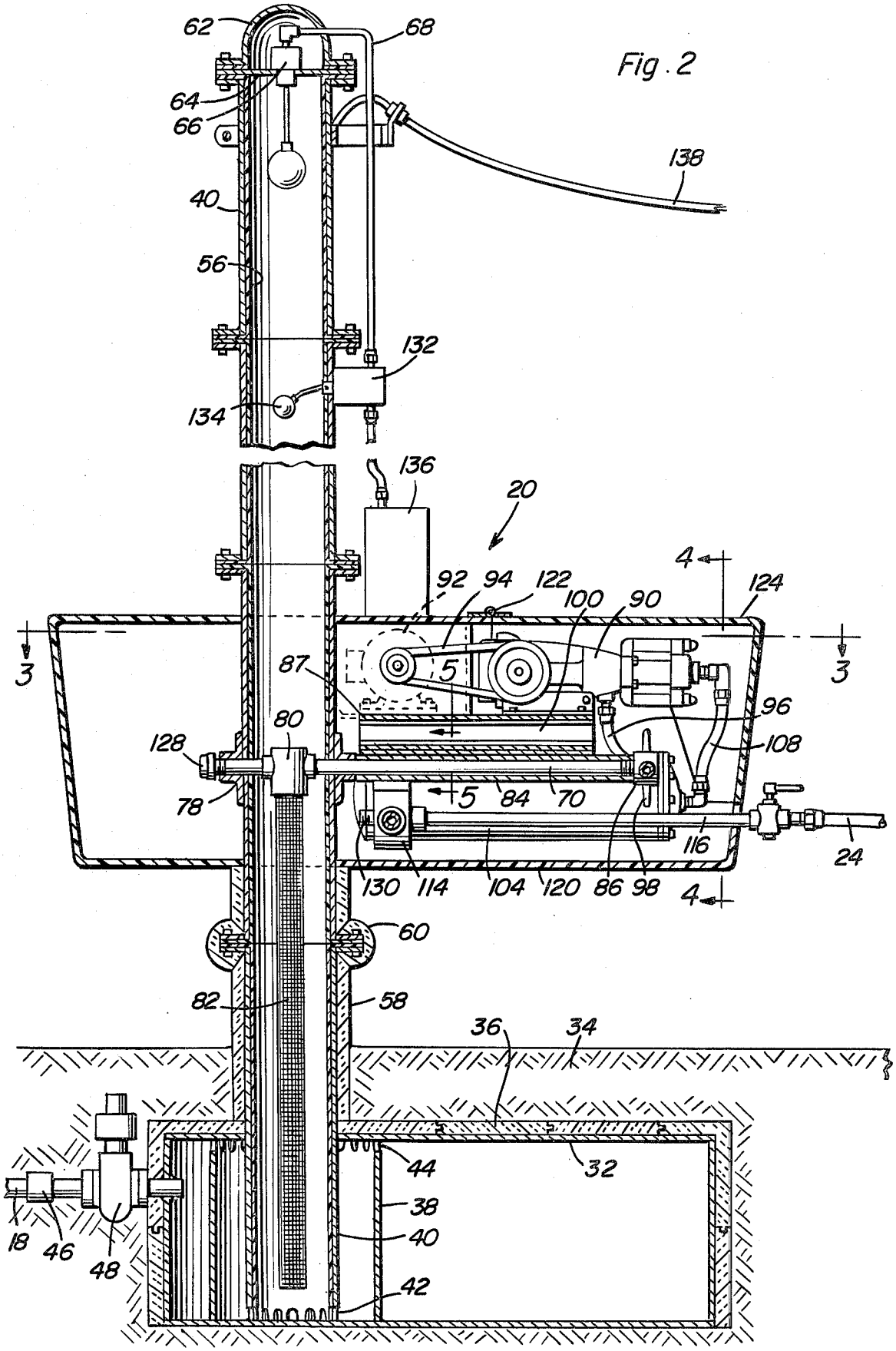
FIG. 2 is a vertical sectional view of the well injector.
Figure 3:
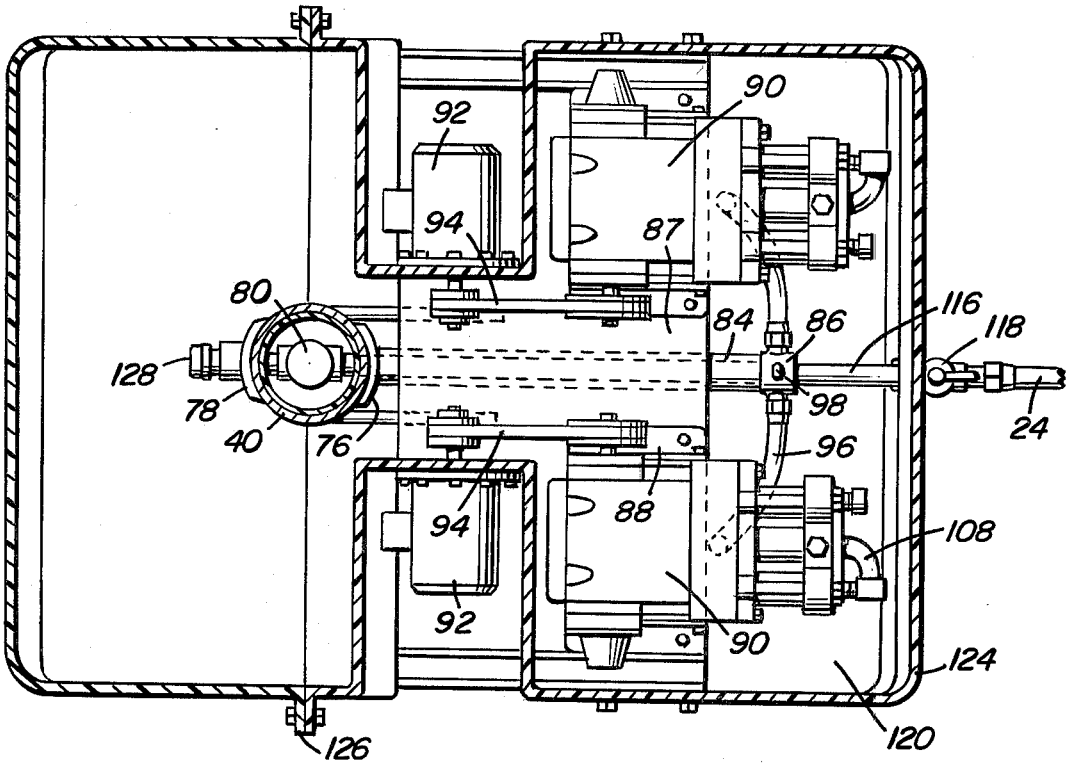
FIG. 3 is a plan sectional view taken substantially upon a plane passing along section line 3—3 of FIG. 2 illustrating the association of the components of the well injector.
Figure 4:
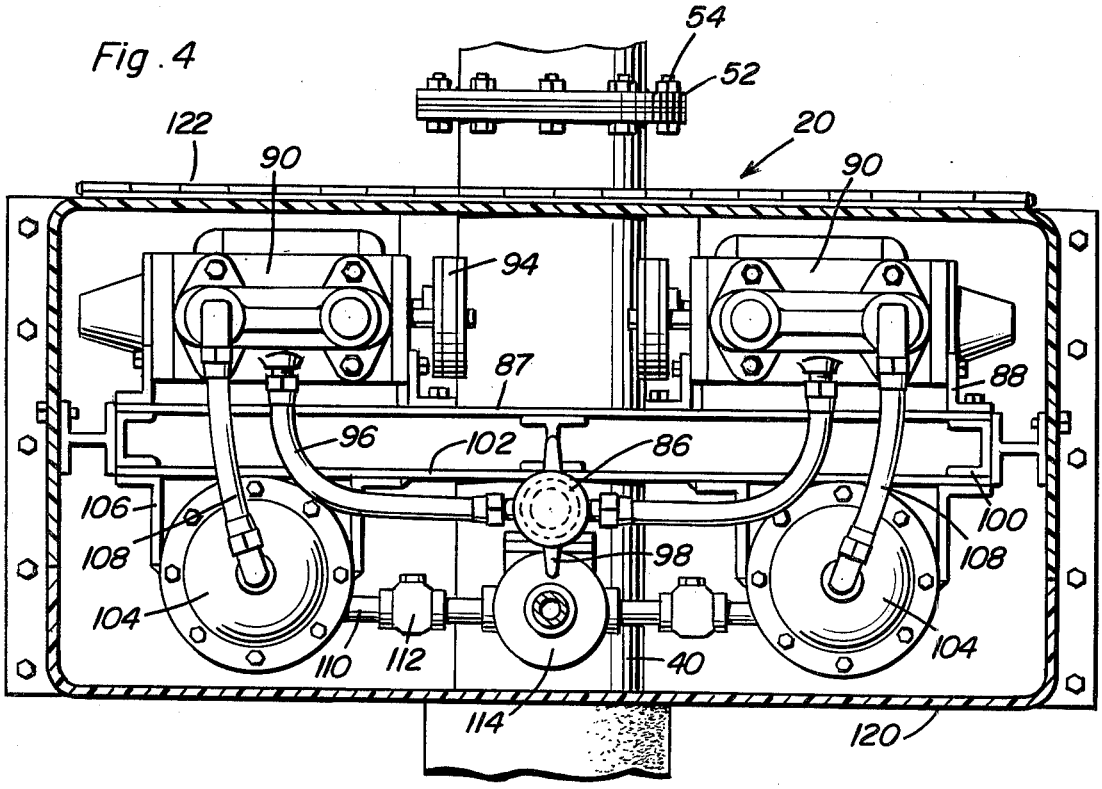
FIG. 4 is a vertical sectional view taken substantially upon a plane passing along section line 4—4 of FIG. 2 illustrating further structural details of the water injector.

Referring now specifically to FIGS. 2-4, the well injector 20 includes a vessel or tank 32 of cylindrical configuration and located below ground 34 a sufficient distance to avoid freezing and to make certain that freezing of the fluid will not occur, a segmented layer of insulation 36 is placed across the top and down the sides of the vessel 32. As illustrated, the tank 32 is provided with a cylindrical baffle 38 extending from the top to bottom thereof disposed in concentric relation to the lower end of a standpipe 40 with the bottom end of the standpipe 40 having notches 42 therein where it joins with the bottom of the tank 32 and the baffle 38 includes notches 44 at the upper end thereof where it joins with the top of the vessel 32 to provide a sediment area in the tank externally of the baffle 38 since the fluid entering the standpipe 40 must initially pass over top of the baffle 38 as defined by the notches 44. The tank 32 is connected to the pipeline 18 through a coupling 46 and a valve 48 located exteriorly to the tank 32 and also positioned underground or otherwise associated with the tank 32 for enabling the supply of fluid to the vessel 32 to be controlled. The pipeline 18 will also have a valve at its juncture with the tank 10 but frequently, the pipeline 18 will serve a plurality of well injectors 20 with the valve 48 on each vessel 32 enabling individual control of the flow rate into each well injector.

Figure 7:
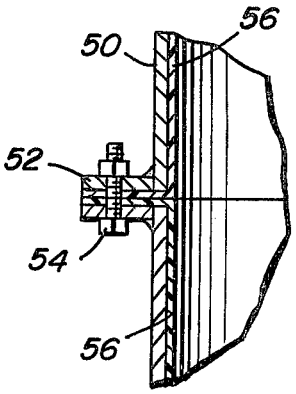
FIG. 7 is a fragmental sectional view of the sectional standpipe or vessel illustrating the structure of the vessel and the connection between the sections.

The standpipe 40 includes a plurality of sections 50 each of which is provided with a flange 52 at each end for connection with adjacent sections by suitable bolts 54. The interior of the sections 50 are coated with plastic non-corrosive material 56, as illustrated in FIG. 7, with the liner or coating 56 also extending between the flanges 52 to provide continuity of the non-corrosive surface on the interior of the standpipe 40. The construction of the standpipe 40 of a plurality of sections enables the height thereof to be varied depending upon the installational requirements with the lowermost section of the standpipe 40 being integral with or welded to the vessel 32 so that the vessel 32 in effect forms a supporting pedestal for the standpipe 40, thereby effectively supporting a vertical column of injection fluid which maintains a height in the standpipe equal to the height of the injection fluid level 12 in the tank 10 as illustrated in FIG. 1. Also, the standpipe 40 is provided with an insulating covering 58 which extends along the flanged coupling as indicated by numeral 60 with this insulation being provided throughout the vertical height of the standpipe or, if desired, the heating device may be provided to maintain the temperature of the injection fluid above freezing. The upper end of the standpipe 40 is provided with a closure dome 62 and a closure plate 64 having a float valve assembly 66 associated therewith and connected with an overflow line 68 which communicates with the interior of the standpipe 40 to enable ingress and egress of air therefrom, but preclude discharge of liquid, since the float valve 66 will close when liquid approaches the plate 64.

The standpipe 40 includes a laterally extending tubular pipe 70 rigidly affixed thereto and extending horizontally therefrom in a cantilevered fashion with the outer end of the pipe 70 being externally threaded as at 72 and the inner end thereof being rigidly supported by a reinforcing partial collar 76 with the inner end of the pipe 70 extending into the interior of the standpipe 40 and projecting from the diametrically opposite side thereof through a similar reinforcing collar 78. A fitting 80 is provided in the pipe 70 within the interior of the standpipe 40 and descending from the fitting 80 is an inlet screen 82 which extends downwardly to the point adjacent to but spaced above the bottom of the vessel 32 as illustrated in FIG. 2, thereby providing communication between the interior of the vessel 32 and the pipe 70.

Mounted on the pipe 70 is an elongated tubular sleeve 84 which has its inner end abutted against the reinforcing collar and flange 76 with its outer end being engaged by a screw threaded cap 86 mounted on the externally screw threaded end 72 of the pipe 70. Rigidly supported on the sleeve 84 is a plate 87 and framework 88 which supports a pair of pumps 90 each of which is provided with an electric motor 92 drivingly connected thereto by a belt drive 94 or the like. Each of the pumps 90 is provided with an inlet conduit 96 communicated with diametrically opposite sides of the cap 86 as illustrated in FIG. 4 with suitable quick disconnect couplings provided therefor so that the conduits 96 are communicated with the pipe 70 thereby providing inlet to the pumps 90 from the vessel 32. The cap 86 is provided with lateral projections 98 which facilitate rotation thereof since the cap 98 serves to detachably retain the entire pump unit mounted on the pipe 70 in a cantilever fashion.

Supported below the plate 87 is additional framework 100 and a plate 102 supporting a pair of longitudinally extending filters 104 by suitable bracket structures 106. The pumps 90 each include a discharge conduit 108 connected to the center outer end of the respective filters 104, which extend parallel to and generally in underlying relation to the pump and motor units as illustrated in FIGS. 2 and 4. The inner ends of the filters 104 are provided with discharge pipes 110 provided with a check valve 112 with the pipes 110 being communicated with a flow meter 114 located between the filters 104 adjacent the inner ends thereof with the discharge of the flow meter 114 connected to a pipe or conduit 116 which extends forwardly between the filters 104 and is connected to the conduit 24 to the well head 28 through a valve structure 118 as illustrated in FIG. 2, thus completing the supply of injection fluid from the vessel 32 into the standpipe 40, through the screen 82, through the pipe 70 and the inlet conduits 96 into the pumps 90. From the pumps 90, injection fluid passes through the outlet conduits 108, through the filters 104, conduits 110, check valve 112 and flow meter 114 into the conduit 116, through the valve 118 and conduit 24 in through the fitting 28 into the well 22 for discharge into a desired underground strata.

The pumps in and of themselves are conventional or triplex, uniflow reciprocating pumps, such as those manufactured by Cat Pumps Corporation, 1600 Freeway Boulevard North, Minneapolis, Minnesota 55430, which was stated to be covered by one or more of the following U.S. Pat. Nos. 3,558,244, 3,652,188, 3,809,508, 3,920,356 and 3,930,756.

To protect the pumps while still enabling the motors 92 to be cooled by the atmosphere, a housing 120 is provided for the pumps 90 while the motors 92 are disposed externally of the housing 120. To provide access to the cap 86 and also the pumps 90, a portion of the housing 120 is hingedly mounted by hinge structures 122 with the top portion of the housing 120 which is hingedly mounted being designated by numeral 124 which opens somewhat in the nature of a protective housing which encloses the pumps, filters and flow meter but does not enclose the motors 92. The housing may be constructed of fiberglass, sheet metal or any other suitable material and may be supported in any suitable manner such as by being rigidly affixed to the standpipe or clamped thereto with the housing 120 being separated into two sections along flanged coupling 126 to facilitate installation of and removal of the housing 120 when desired. The housing may be anchored to longitudinal frame members 128 and separated horizontally into top and bottom sections to enable easy removal and installation thereof. The entire pump assembly along with the motors, filters, flow meter and associated piping conduits are removed as a unit from the supporting pipe 70 after the inlet conduits 96 have been detached from the cap 86 and the cap removed from the end of the pipe 70, thus facilitating removal of the pump unit for repair or replacement. This structure also enables bypass of the pump units where the underground strata is such that gravity flow flooding with the injection fluid either going directly from the pipe 70 into the filters 104 thus bypassing the pumps, or a direct connection can be made to the conduit 24, thus bypassing the pumps, filters and flow meter, although it usually is desirable to maintain control of the flow rate and also enable monitoring of the flow rate.

Figure 6:
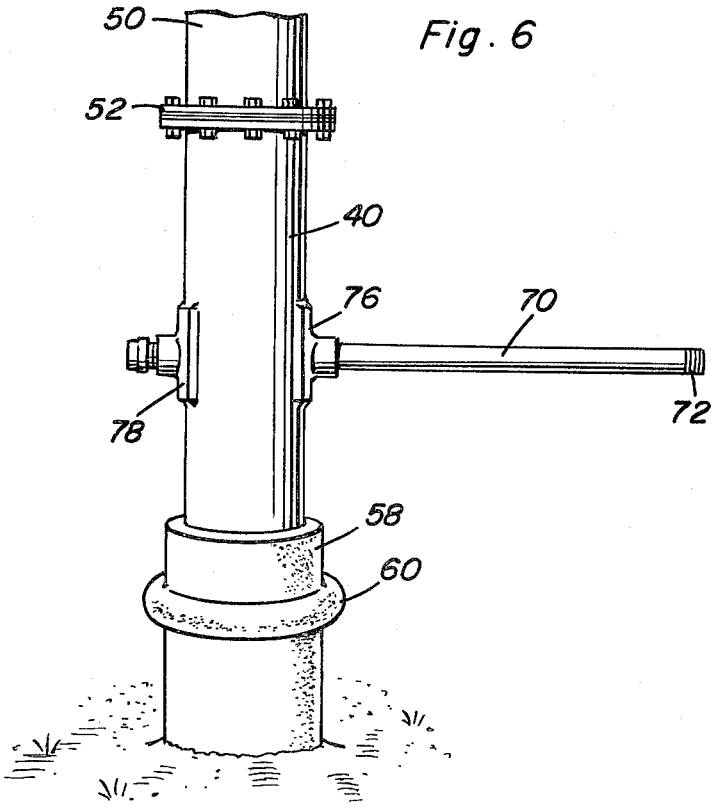
FIG. 6 is a fragmental perspective view of the supporting structure for the pump and filter assembly.
Figure 5:
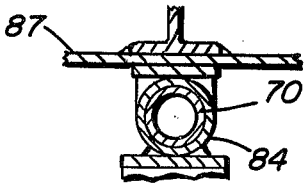
FIG. 5 is a fragmental sectional view taken substantially upon a plane passing along section line 5—5 of FIG. 2 illustrating further structural details of the supporting structure for the pump and filtering assembly.

As illustrated in FIGS. 2, 3 and 6, the pipe 70 which extends through the fitting 80 interiorly of the standpipe 40 also includes an end portion extending through the coupling 80 which is provided with a cap 128 which forms a closure therefor and is provided to enable a chemical injection pump to be supported from a pipe attached thereto by a suitable coupling in a cantilever manner similar to the pipe 70 which supports a chemical injection pump unit (not shown) which is communicated with the interior of the standpipe in the same manner as pipe 70 and which includes a discharge conduit connected to the flow meter 114 by a suitable adapter 130, so that chemical additives may be added to the injection fluid on the downstream side of the filters 104. The use of a chemical additive injector pump is optional depending upon the installation requirements and the chemical injection pump will be a self-contained, commercially available unit powered by a suitable electric motor.

Also, the standpipe 40 is provided with a float control switch 132 having a float 134 connected thereto which will control the water level in the standpipe within certain limits with the float valve 66, of course, preventing fluid overflow of the standpipe. The discharge line 68 extends into a sterilizer 136 which enables discharge of air from the standpipe but when the fluid level in the standpipe recedes, incoming air will be sterilized, thereby preventing growth of alga or bacteria in the water in standpipe 40. Also, the standpipe 40 may serve as a supporting post for an electrical conductor 138 or the like to supply electrical energy to the pump motors and also to enable sensing and control signals to be remotely provided to the injector to enable the well injector conditions to be monitored and controlled from a remote location as desired.

When a formation in which fresh water is being stored is sufficiently permeable to provide free flow into the underground strata, the pumps can be bypassed and, of course, not operated until such time as water backs up into the standpipe to a predetermined level at which time a sensing switch will render the pumps operative. In situations where water is conveyed for relatively long distances with substantial gravity fall, hydroelectric generators may be incorporated into split lines at various locations including the terminal end of the pipeline in order to generate electricity for various purposes including providing power to the injector pumps. Such generators would be conventional and would be feasible wherever the water head or gravity fall of water is sufficient to power conventional turbine driven generators. Also, where wells take a large gravity flow of water having a substantial head, downhole water driven turbine-generator units may be provided to produce electrical energy for various purposes including the powering of control apparatuses, drive motors, and the like, of the system.

In addition to installation in association with secondary or tertiary recovery of hydrocarbons and storage of fresh water in underground strata, the well injectors are well adapted for disposal of salt water or brine in oil fields in which a smaller unit incorporating a single pump provided with a drive motor and including or omitting filtering, metering and other accessories enables injecting oil field salt brine into underground disposal strata. In such installations, a low pressure line may be connected to a single or a plurality of siphon lines or to an elevated holding tank where water will flow by gravity or pumped by a low pressure, high volume, pressure regulated pumps to the well injectors where automatic injection will be accomplished by the small vessel injector units. Also, a small injector unit may be used by ranchers, farmers, industrial users, or the like, for recharging underground water strata during wet seasons, that is, for storing fresh water for point of use rather than for use by the general population. The same general construction can be used for underground disposal of any fluids contaminated by industrial processes or the like bearing in mind that certain materials, for safety and health reasons, should not be injected underground.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A multiple-purpose underground fluid injection system for discharging fluid into a desired underground strata through a well communicated with only the desired underground strata, said system including a well injector communicated with a supply of injection fluid and a well, said well injector including a vessel in low-pressure, high-volume communication with a supply of injection fluid, said vessel including a standpipe connected to the top of said vessel and extending upwardly therefrom and in communication therewith and receiving injection fluid from the vessel, and pump means mounted between the standpipe and the well and communicating directly with the standpipe and the well for controlling flow of injection fluid into the well.

2. A multiple-purpose underground fluid injection system for discharging fluid into a desired underground strata through a well communicated with only the desired underground strata, said system including a well injector communicated with a supply of injection fluid and a well, said well injector including a vessel in low-pressure, high-volume communication with a supply of injection fluid, said vessel including a standpipe extending upwardly therefrom and in communication therewith and adapted to receive injection fluid, and means communicating the standpipe with the well for controlling flow of injection fluid into the well, said means communicating the standpipe with the well includes pump means, filter means and a flowmeter mounted on a support structure disposed laterally of the standpipe, and means removably mounting said support structure from the standpipe, said mounting means including a rigid pipe extending generally horizontally from the standpipe in cantilever fashion and in communication therewith, said support structure including a rigid sleeve telescoped over said cantilever pipe, and a removable cap on the outer end of said rigid pipe for removably retaining the sleeve on the pipe.

3. The system as defined in claim 2 wherein said cap includes a conduit connected thereto communicating the rigid pipe with the pump means to supply injection fluid to the pump means.

4. The system as defined in claim 3 wherein said pump means includes a pair of pumps mounted on said support structure on opposite sides of said sleeve, a motor driving each of said pumps, said filter means including an elongated filter mounted on said support structure on opposite sides of said sleeve and generally in parallel relation to the sleeve, an outlet conduit connecting each pump with a filter, said flowmeter being in communication with the discharge of said filters and including a conduit extending to the well, whereby the support structure including the pumps, motors, filters and flowmeter can be removed from the cantilever pipe as a unit.

5. The system as defined in claim 2 wherein said vessel is disposed below ground to form a supporting base for the standpipe and components mounted thereon.

6. The system as defined in claim 2 wherein said vessel is in communication with an elevated tank through a non-corrosive, non-conducting pipeline for gravity flow.

7. The system as defined in claim 5 wherein said vessel is disposed below ground to form a supporting base for the standpipe and components mounted thereon, said rigid pipe extending into the interior of the standpipe and including an inlet screen extending downwardly in the standpipe to supply injection fluid to the pumps, said standpipe including a closed upper end, said standpipe including float valve means to enable ingress and egress of air but preclude discharge of liquid from the standpipe other than through the rigid pipe.

* * * * *